United States Patent [19]

LeCart

[11] Patent Number: 4,483,535

[45] Date of Patent: Nov. 20, 1984

[54] TRIANGLE COMBINATION GAME

[76] Inventor: Jean-Guy LeCart, 19 Rue Robert Schumann, 95300 Pontoise, France

[21] Appl. No.: 446,643

[22] Filed: Dec. 3, 1982

[30] Foreign Application Priority Data

Dec. 4, 1981 [FR] France ..... 81 22707

[51] Int. Cl.[3] ..... A63F 9/08

[52] U.S. Cl. ..... 273/153 S; 273/155

[58] Field of Search ..... 273/153 R, 153 S, 155; 46/1 R

[56] References Cited

U.S. PATENT DOCUMENTS

| | | | |
|---|---|---|---|
| 609,995 | 8/1898 | Murphy | 273/153 R |
| 636,109 | 10/1899 | Bowers | 273/153 S X |
| 2,095,046 | 10/1937 | Wilner | 273/153 R |

FOREIGN PATENT DOCUMENTS

| | | | |
|---|---|---|---|
| 2405077 | 5/1979 | France | 273/153 S |
| 2463632 | 2/1981 | France | 273/153 S |
| 2490102 | 3/1982 | France | 273/153 S |
| 170062 | 10/1976 | Hungary | 273/153 S |

*Primary Examiner*—Anton O. Oechsle

*Attorney, Agent, or Firm*—Rines and Rines, Shapiro and Shapiro

[57] ABSTRACT

This disclosure is concerned with a puzzle type game involving an equilateral triangle assembly of hexagonal-form sub-assemblies of side-by-side components, wherein adjacent sub-assemblies share two common components and are held together in assembly but adapted for rotation of each sub-assembly around its own center.

3 Claims, 3 Drawing Figures

TRIANGLE COMBINATION GAME

This device is a game of the "puzzle" type combining several components in modifiable combinations by translation or rotation motions.

I am familiar with (Pat. No. HU-A-170 062 RUBIK) a game consisting of twenty-seven small cubes, which can be color identified, and which can be combined in a manner so as to permit the rotation of each of the six faces of the large cube.

I am also familiar with a game (Pat. Nos. FR-A-2463 632, FR-A-2405 077 and FR-A-2490 102 RABA) associating components to base rotation motions around parallel axes.

The components of this latter game have the shape of curvilinear triangles and are not all identical. Because of that fact, all rotation motions are not possible and the number of combinations is limited.

Furthermore, the various means for motion control and holding the components together, described in the aforementioned patents, are very different from the considerably simpler solution of the device of my invention.

This device is a game of the puzzle type which associates components to base rotation motions around several parallel axes, without limiting the number of combinations, by means of simple mechanisms for motion control and for holding components together.

One of the objectives of the game is to combine in different ways components and to suggest to players new problems to be solved. The flat shape of the device permits the game to be carried in pockets of garments without spoiling or deforming them. Through the specific identification of components, this game has several levels of complexity.

The game comprises at least thirteen components, the shape of each of which is that of an equilateral triangle, which are placed side by side so as to form sub-assemblies of hexagonal form which fit into each other so that each sub-assembly has with each adjacent sub-assembly two common components. The components are held together but at the same time permitting a rotation motion of each sub-assembly around its own center.

In one version of the device, each component comprises two similar sides (walls) rigidly connected by an axis. The components are held together by an external elastic strap bearing upon the axes of the components located on the edge of the assembly and inserted between the sides of these components, while discs located in the center of these so-called hexagonal sub-assemblies and between the edges of the components which make them up, contribute to the cohesiveness of the assembly.

The discs are bevelled in order to simplify the rotation motion of the sub-assemblies. The player creates these motions by squeezing with one hand the sub-assembly he wishes to rotate and applies a torque in the desired direction, and for angles in multiples of 60 degrees, while at the same time holding the remaining components of the assembly with the other hand.

In order to also simplify the shifting of the sub-assemblies, the axes are equipped with pulleys upon which the external strap rests, and the angles of each component are rounded.

Figure 1:
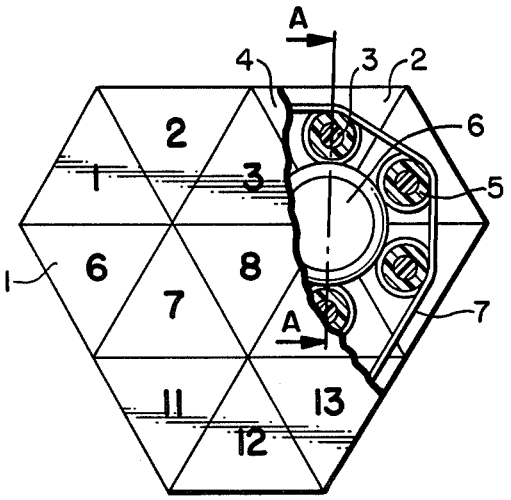
FIG. 1 shows the front view of a version of the device with a partial sectional view in the symmetry plane of the assembly.

As shown in these views, the game comprises thirteen similar components 1 each of which has the shape of an equilateral triangle. Each component comprises a first side 2 extended by an axis 3. A pulley 5 is mounted on the axis 3 before the opposite side 4 is glued to the axis 3.

Figure 2:
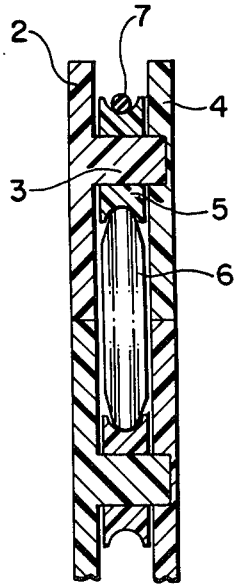
FIG. 2 is an enlarged view through a plane AA passing through the axes of two components.

The thirteen components are held together by means of an external elastic strap 7 which goes over the pulleys of the external components. Three discs 6 are inserted between the pulleys and the sides of the components at the center of each hexagonal sub-assembly formed by six components placed side by side, permitting all components to remain in the same plane. The central component is thus locked in by three discs. As can be seen in FIG. 2, the peripheries of discs 6 are bevelled for proper engagement in the peripheral grooves of pulleys 5.

As a result of the elasticity of the strap 7, it is possible to rotate each sub-assembly with respect to the seven remaining triangles.

The player proceeds as follows:

He squeezes between the thumb and the forefinger the sub-assembly that he wishes to rotate and gives it a torque while utilizing the other hand (one finger could suffice) to block the rotation of the remaining components.

He selects, at his convenience, the direction of rotation and the angle in multiples of 60 degrees.

He thus modifies the make-up of the sub-assemblies and he can seek to achieve particular combinations of colors or numbers. In fact, each component has one color and one number, which number is from 1 to 13. The puzzles thus can be of increasing difficulty according to whether one seeks to make up assemblies of colors (easy) or make up assemlies showing numbers properly ordered and oriented (very hard).

Preferably, the game is made of molded thermoplastic material.

Figure 3:
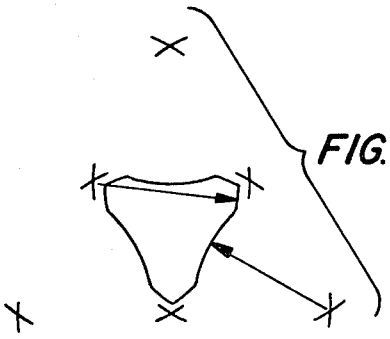
FIG. 3 is a diagrammatic view of a modification.

To simplify the shifting of the sub-assemblies, the sides of the components could be grooved in the form of an arc and/or their angles could be rounded as shown in FIG. 3, but preferably I utilize an external strap which is sufficiently flexible.

If the number of hexagonal sub-assemblies is increased by adding components in multiples of three and one disc for each three components, the resulting device is basically the same.

I can also identify each component by the portion of an image as is done in ordinary puzzles, or utilize a great enough number of numbered components on one of the faces, for example from 1 to 49, in such a manner as to obtain random groups of 6 numbers; this could create an interest in the playing of a game of chance.

I claim:

1. A game of the puzzle type combining an assembly of components in modifiable combinations by rotation of selected sub-assemblies of components about parallel axes, characterized in that the game comprises at least thirteen components whose general shape is that of an equilateral triangle, each component having two spaced walls connected rigidly by an axis, the components being placed side by side in such a manner as to create sub-assemblies of hexagonal form with each sub-assembly having two components in common with an adjacent sub-assembly, means for holding the components side by side while permitting rotation of each sub-assembly around its own center, said holding means including an elastic strap passing over the axes of peripheral components of the assembly between the walls thereof, each hexagonal sub-assembly having a disc located at the center of that sub-assembly between the walls of the components of that sub-assembly and between the axes of the components of that sub-assembly.

2. A game in accordance with claim 1, further characterized in that each axis has a pulley thereon adapted to engage the strap.

3. A game in accordance with claim 2, further characterized in that each disc is beveled at its periphery and has its periphery engaged with adjacent pulleys.

* * * * *